US009027176B2

(12) United States Patent
Dabrowski

(10) Patent No.: US 9,027,176 B2
(45) Date of Patent: May 12, 2015

(54) BATHING AREA SURROUND

(75) Inventor: Peter Dabrowski, Macomb, MI (US)

(73) Assignee: Masco Corporation, Taylor, MI (US)

( * ) Notice: Subject to any disclaimer, the term of this patent is extended or adjusted under 35 U.S.C. 154(b) by 2597 days.

(21) Appl. No.: 11/670,117

(22) Filed: Feb. 1, 2007

(65) Prior Publication Data

US 2008/0184477 A1 Aug. 7, 2008

(51) Int. Cl.
*A47K 3/02* (2006.01)
*A47K 3/04* (2006.01)

(52) U.S. Cl.
CPC ..... *A47K 3/04* (2013.01); *Y10T 29/49826* (2015.01)

(58) Field of Classification Search
CPC ..... A47K 3/02
USPC ..... 4/584, 596, 614, 599; 52/588.1, 579
See application file for complete search history.

(56) References Cited

U.S. PATENT DOCUMENTS 2,190,490 A 2/1940 Sendzimir
4,384,377 A 5/1983 Calvert et al.
4,671,026 A * 6/1987 Wissinger ..... 52/35
4,901,380 A 2/1990 Smith
4,993,201 A * 2/1991 Bunyard ..... 52/35
5,263,208 A 11/1993 Smith
6,295,771 B1 10/2001 Desjoyaux et al.
6,425,147 B1 * 7/2002 Hanson ..... 4/584
6,434,764 B2 8/2002 Primucci
6,647,562 B1 * 11/2003 Arout et al. ..... 4/506
6,647,563 B1 11/2003 Smith
6,691,339 B1 2/2004 Thomas

OTHER PUBLICATIONS

Installation Guide, Bath and Wall Surrounds, http://www.sterlingplumbing.com/onlinecatalog/pdf/1018998_2.pdf.

* cited by examiner

*Primary Examiner* — Lori Baker
(74) *Attorney, Agent, or Firm* — Carlson, Gaskey & Olds, PC

(57) ABSTRACT

An example bathing area surround includes panels having a slot flange and a hook flange. A hook-like projection on the hook flange of a first panel is extendable into a slot on the slot flange of a second panel. Another example bathing area surround includes the slot flange on a first bathing panel and the hook flange on a second bathing panel, and a seal located on at least one of the slot flange or the hook flange. The seal may comprise foam. The foam may be compressed.

19 Claims, 3 Drawing Sheets

BATHING AREA SURROUND

BACKGROUND OF THE INVENTION

This invention relates generally to bathing area surrounds. More particularly, this invention relates to securing panels of a bathing area surround.

Moisture may splash or leak away from a bathing area during a bath or shower. Such moisture may damage areas adjacent the bathing area, such as bathroom walls or a bathroom floor. Bathing area surrounds protect the adjacent areas from moisture damage by deflecting moisture toward the bathing area or otherwise preventing the moisture from moving outside the bathing area. Some bathing areas, such as tubs or showers, include bathing surrounds designed to direct moisture down the walls of the surround and to the base of the bathing area for draining.

Most bathing areas are large enough to accommodate an adult. Bathing surrounds typically mount adjacent at least three sides of the bathing area. Accordingly, most bathing surrounds typically include a side at least as large as a length of the tub or shower. Manipulating a one-piece bathing surround into a position adjacent the tub or shower is often awkward due the size of the bathing surround and the size of a typical bathroom or doorway opening. Accordingly, many bathing surrounds include multiple panels, which are individually maneuvered into positions adjacent the bathing area. Paneled bathing surrounds are especially useful if replacing an existing bathing surround. The individual surround panels can be moved through the home for installation without requiring modifications to the home, such as widening a door opening.

Paneled bathing surrounds include interfaces where adjacent panels of the surround join. Although paneled bathing surrounds are useful for installation, the interfaces are challenging to seal. If not properly sealed, the interfaces could provide a convenient pathway for moisture to escape from the bathing area.

To seal the interfaces, many bathing surround designs incorporate panel fasteners for tightly securing adjacent panels of a bathing surround to prevent leakage through the interfaces. However, using fasteners increases the overall cost of the bathing surround and the complexity associated with installing the surround. Caulking is also sometimes used, but caulking the interfaces adds a step to the bathing surround assembly process.

Some bathing surrounds use mechanical interlocking connectors for joining adjacent panels. The interlocking connectors may include a pin on one panel that slides over an upturned finger or interlock slot on an adjacent panel. These types of mechanical interrelating connectors are not fully successful in securing adjacent panels of a surround. Further, the detail required to form the pin or finger complicates the manufacturing processes used to produce the individual panels.

It would be desirable to achieve a substantially leak proof paneled bathing surround without requiring added fasteners.

SUMMARY OF THE INVENTION

An example bathing area surround includes panels having a slot flange and a hook flange. A hook-like projection on the hook flange of a first panel is extendable into a slot on the slot flange of a second panel.

The bathing area surround includes a seal located on at least one of the slot flange or the hook flange. The seal may comprise foam. The foam may be compressed.

In one example bathing area surround, relative movement of the hook flange toward the slot flange and then sliding of the hook flange relative to the slot flange engages the hook-like projection to the slot flange. The hook-like projection may include a tapered end portion that causes relative movement of the hook flange toward the slot flange as the hook-like projection moves to an engaged position. The hook-like projection may be cut into the hook flange. The slot may be cut into the slot flange.

An example method of joining panels of a bathing area surround includes moving a hook-like projection of a hook flange through an slot of a slot flange, and caming the hook flange and the slot flange with the hook-like projection. The hook-like projection abuts and moves the slot flange and hook flange together. The method may include compressing a foam seal between the slot flange and the hook flange.

The method may include guiding the hook-like projection through the slot by contacting an extension of the slot flange with the hook flange prior to moving the hook-like projection through the slot of the slot flange.

BRIEF DESCRIPTION OF THE DRAWINGS

These and other features of the present invention can be best understood from the following specification and drawings, the following of which is a brief description.

DETAILED DESCRIPTION OF THE PREFERRED EMBODIMENT

Figure 1:
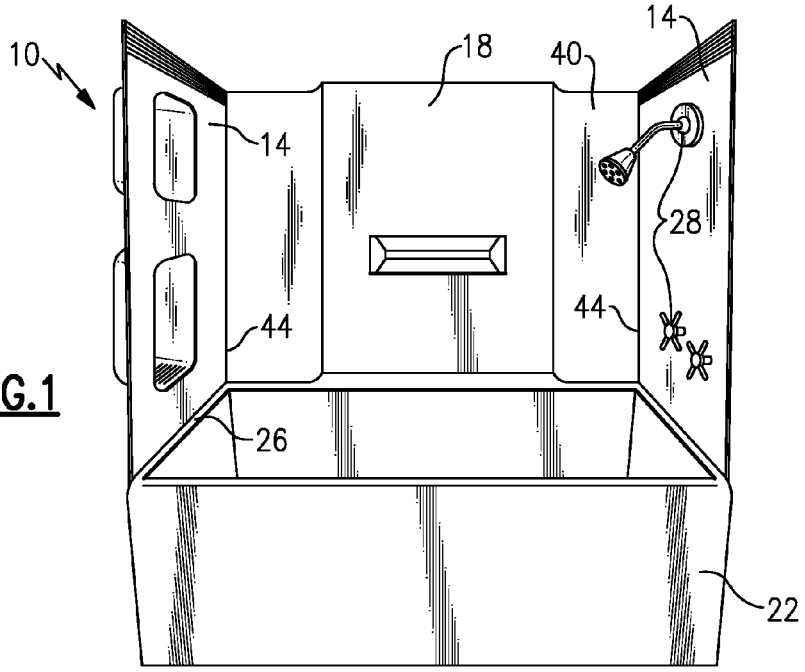
FIG. 1 illustrates an example bathing area and associated bathing surround.

An example bathing area surround 10 includes side panels 14 and a back panel 18, as shown in FIG. 1. In this example, the bathing surround 10 mounts adjacent a tub 22. The side panels 14 and the back panel 18 contact a tub ledge 26 and direct moisture down their walls and into the tub 22. The bathing surround 10 also provides access for plumbing fixtures 28, which provide water to tub 22.

The bathing surround 10 mounts adjacent three sides of tub 22. The remaining open side provides access to the tub 22. This remaining side may be covered by a hinged or sliding door (not shown) or a curtain. Although tub 22 is illustrated as a bathing tub, those skilled in the art, and with the benefit of this disclosure, may understand that tub 22 may be a showering tub. For example, the tub 22 may be much shallower tub, such a tub 22 for use in a shower stall.

In this example, the side panels 14 and the back panel 18 are vacuum formed from sheets of Acrylonitrile Butadiene Styrene (ABS) or Polystyrene. Vacuum forming a structural strengthening feature 40 into the panel, such as a rib or grove, may enhance the overall rigidity of bathing surround 10.

The side panels 14 and the back panel 18 meet at interfaces 44. Improperly sealed interfaces 44 could provide an escape path for moisture through the bathing surround 10. Forming the side panels 14 and the back panel 18 from solid sheets lessens moisture escape paths through other areas of the bathing surround 10.

Figure 2:
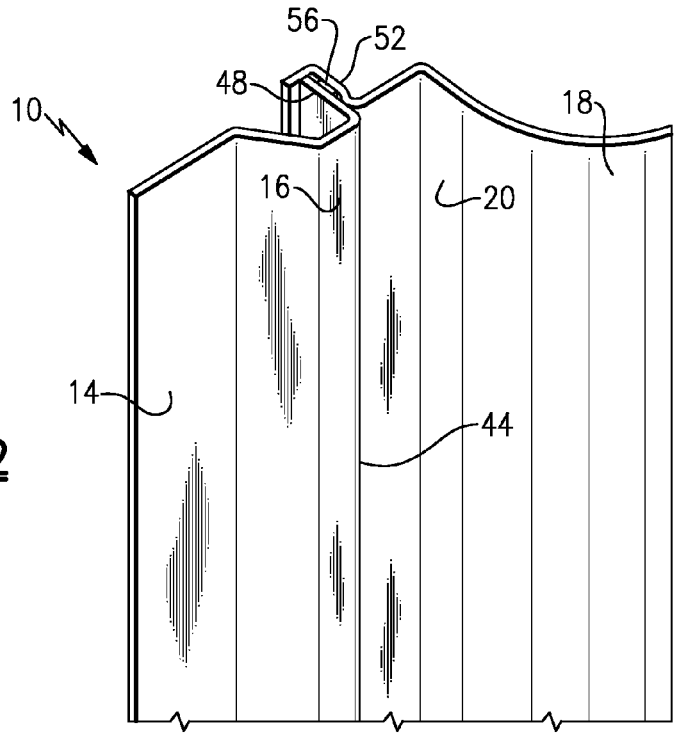
FIG. 2 illustrates an interface between panels of a bathing surround.
Figure 3A:
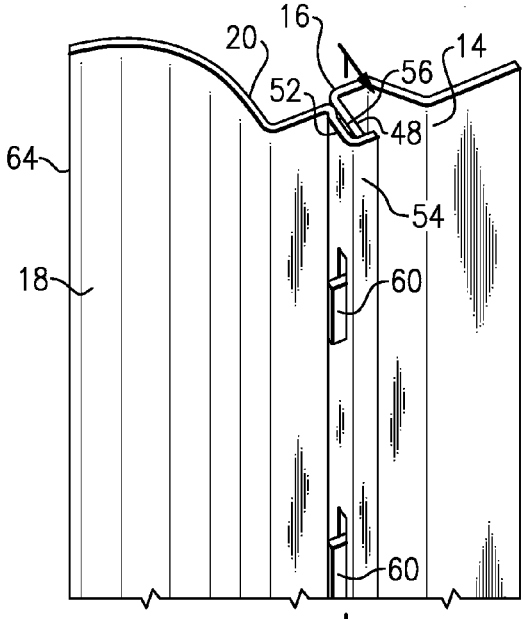
FIG. 3*a* illustrates another view of an interface between panels of a bathing surround.

FIG. 2 illustrates the interface 44 between the side panel 14 and a back panel 18. The interface 44 includes a hook flange 48 and a slot flange 52 sandwiching a seal 56. Provided the seal 56 is suitably positioned, the seal 56 prevents moisture from escaping from the bathing surround 10 through the interface 44. To properly position seal 56 within the interface 44, the side panels 14 and back panel 18 are secured relative to each other. As shown in FIG. 3*a*, a hook-like projection 60 extends from the hook flange 48. In the engaged position, the hook-like projection 60 moves through a slot 64 to engage the slot flange 52. When in the engaged position, the hook-like projection 60 contacts the slot flange 52 and prevents the side panel 14 from moving away from the back panel 18 without first disengaging the hook-like projection 60. The hook flange 48 may include more than one hook-like projection 60 for engaging more than slot 64 of the slot flange 52.

Figure 3B:
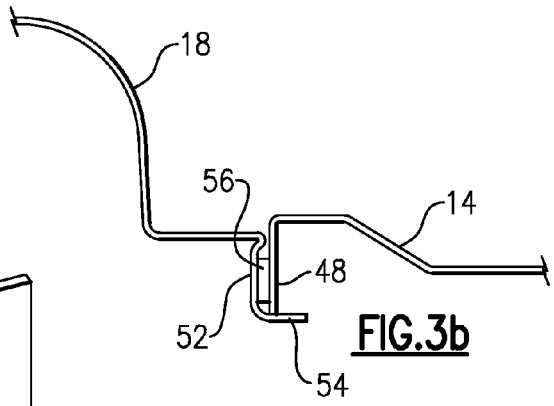
FIG. 3*b* illustrates a top view of the interface shown in FIG. 3*a*.

In this example, the hook flange 48 and the slot flange 52 sandwich the foam tape 56. As shown in the top view of FIG. 3*b*, the slot flange 52 has a general cross sectional L-shape including a return flange 54. During assembly, the return flange 54 may act as a stop for guiding the hook flange 48 into a position appropriate for inserting the hook-like projection 60 into the slot 64. For example, the end of the hook flange 48 may contact the return flange 54 as the side panel 14 moves toward the back panel 18 during assembly. Maintaining contact with the return flange 54 ensures the horizontal alignment of the hook-like projection 60 relative to the slot 64 as the hook-like projection 60 moves through the slot.

The example bathing area surround 10 includes a side display face 16 on the side panel 14 and a back display face 20 on the back panel 18. The side display face 16 is transverse to the back display face 20. The hook flange 48 extends away from the side panel 14 in a direction generally aligned with the back display face 20 and transverse to the side display face 16. The hook-like projection 60 extends transversely from the hook flange 48 and is generally aligned with the side display face 16. The return flange 54 portion of the slot flange 52 extends transverse to the other portions of the slot flange 52, which are generally aligned with the back display face 20. Thus the return flange 54 aligns generally with the side display face 16, and the other portions of the slot flange 52 align generally with the back display face 20.

Figure 3C:
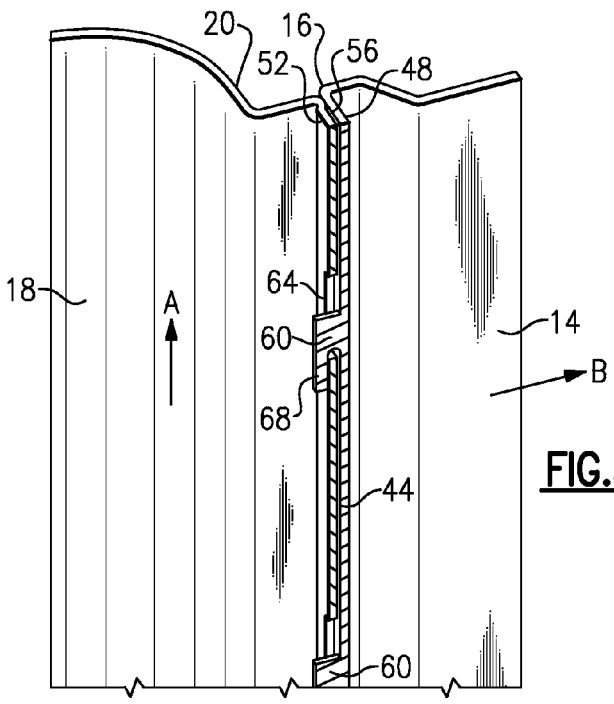
FIG. 3*c* illustrates a partial cutaway of the interface shown in FIG. 3*a*.

As shown in the sectional view of FIG. 3*c*, the hook-like projection 60 is hook-shaped and includes a hook end 68. The hook end 68 prevents disengaging the side panel 14 from the back panel 18 by requiring the associated side panel 14 to move at least some distance in a first direction A before moving the side panel 14 in a second direction B. Accordingly, preventing movement of the side panel 14 in a first direction A would prevent movement of the side panel 14 in a second direction B.

Assembly of the bathing surround 10 with the hook-like projection 60 and slot 64 can occur by first positioning the back panel 18. Next, the side panel 14 moves toward the back panel 18 to move the hook-like projection 60 through the slot 64. The side panel 14 then moves toward the tub ledge 26 such that the hook-like projection 60 engages the slot flange 52.

Figure 4A:
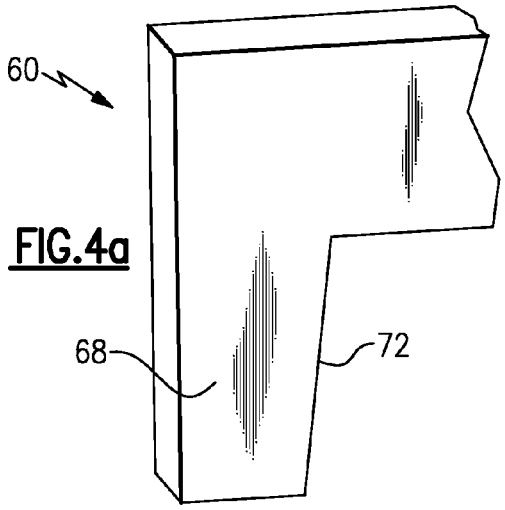
FIG. 4*a* illustrates a hook-like projection for joining panels of a bathing surround.
Figure 4B:
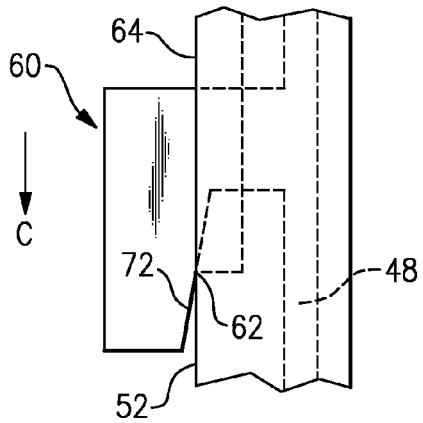
FIG. 4*b* illustrates a position of the hook-like projection relative to a back panel flange as the hook-like projection moves toward an engaged position.

To aid in sealing the interface 44, the hook-like projection 60 may include a tapered portion having a tapered edge portion 72 on the end of the hook 68, as shown in FIG. 4*a*. The tapered edge 72 tends to draw the hook flange 48 and the slot flange 52 together as the hook-like projection 60 moves to an engaged position. That is, the tapered edge portion 72 forces the slot flange 52 to move toward the hook flange 48 as the hook-like projection 60 engages the slot flange 52. FIG. 4*b* illustrates the hook-like projection 60 partially engaging the slot flange 52. As the hook-like projection 60 moves further downward in a direction C, the tapered edge portion 72 contacts an slot edge portion 62 to cam the slot flange 52 toward the hook flange 48. Once engaged, the hook flange 48 and the slot flange 52 sandwich the seal 56 to prevent leaking through the interface 44.

Figure 5:
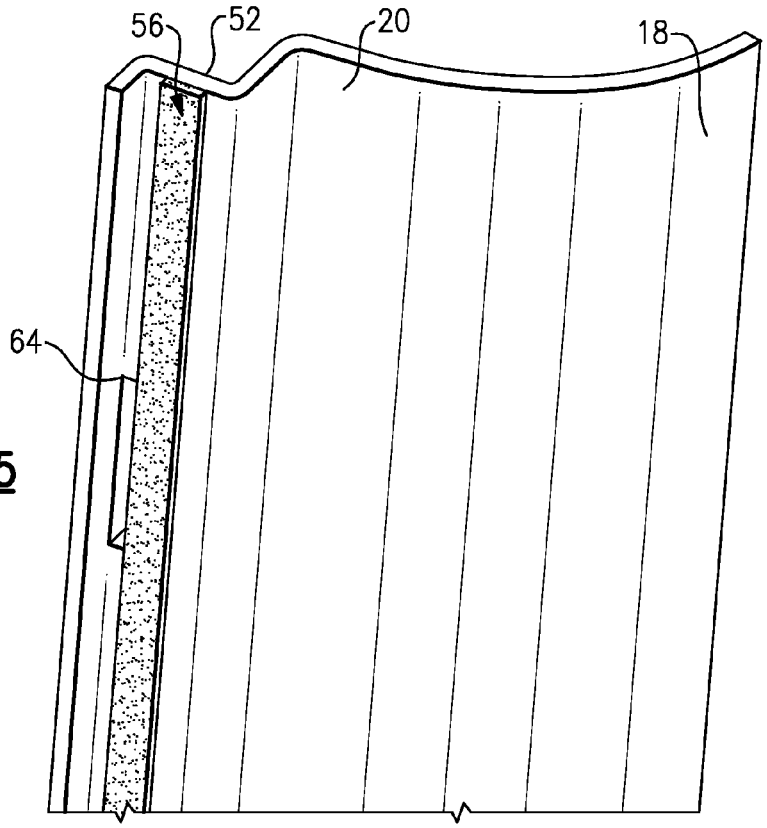
FIG. 5 illustrates a seal mounted to a back panel flange.

As shown in FIG. 5, in this example, the seal 56 attaches directly to the slot flange 52 and extends along the interface 44 (FIG. 3*c*). Accordingly, when adequately compressed, the seal 56 blocks moisture passage through the interface 44. In this example, the seal 56 is a foam tape seal, which, when compressed, prevents moisture passage.

The hook-like projection 60 may be formed as a portion of the hook flange 48. In one example, a water jet cuts the hook-like projection 60 into the hook flange 48 after the side panel 14 is vacuum formed. Incorporating the hook-like projection 60 into the hook flange 48 secures the interface 44 without requiring added parts. As with the hook-like projection 60, the slot 64 may be cut into the slot flange 52 using the water jet after the vacuum forming the back panel 18. Although described as having the hook-like projection 60 on the side panel 14 for engaging the back panel 18, those skilled in the art and having the benefit of this disclosure may understand other areas of the bathing surround 10 suitable for securing side panels 14 and a back panel 18. For example, the back panel 18 may include the hook-like projection 60 and the side panel 14 may include the slot.

While a three-piece bathing surround 10 is shown, this invention extends to two-piece surrounds, or other arrangements.

The preceding description is exemplary rather than limiting in nature. Variations and modifications to the disclosed examples may become apparent to those skilled in the art that do not necessarily depart from the essence of this disclosure. The scope of legal protection given to this invention can only be determined by studying the following claims.

I claim:

1. A bathing area surround, comprising:

a slot flange including a slot, said slot flange extending from a first bathing panel;

a hook flange extending from a second bathing panel; and a hook-like projection of said hook flange engageable into said slot of said slot flange.

2. The surround of claim 1, including a seal on at least one of said slot flange and said hook flange.

3. The surround of claim 2, wherein said seal comprises foam.

4. The surround of claim 3, wherein said foam is compressed when said hook-like projection engages said slot.

5. The surround of claim 1, wherein relative movement of said hook flange toward said slot flange and then sliding said hook flange relative to said slot flange engages said hook-like projection to said slot flange.

6. The surround of claim 1, wherein said hook-like projection includes a tapered end portion.

7. The surround of claim 6, wherein said tapered end portion causes relative movement of said hook flange toward said slot flange as said hook-like projection moves to an engaged position.

8. The surround of claim 1, wherein said hook-like projection is cut into said hook flange.

9. The surround of claim 1, wherein said slot is cut into said slot flange.

10. The surround of claim 1, wherein said slot flange includes a portion generally aligned with a display face of said first bathing panel and a portion transverse to said bathing panel.

11. The surround of claim 1, wherein said hook flange extends transverse to a display face of said second bathing panel.

12. The surround of claim 1, wherein said hook-like projection is hook-shaped.

13. The surround of claim 1, wherein said slot of said slot flange is an aperture established within said slot flange.

14. The surround of claim 1, wherein said hook-like projection comprises a hook end that extends through said slot when said hook-like projection is engaged into said slot of said slot flange, said hook end configured to limit movement of the first bathing panel relative to the second bathing panel.

15. The surround of claim 1, where at least a portion of said hook-like projection is received within said slot when said hook-like projection is engaged into said slot of said slot flange, said hook-like projection configured to move a portion of said slot flange relatively toward a portion of said hook flange as said hook-like projection is moved downward relative to said slot flange.

16. The surround of claim 1, wherein said hook flange, said hook-like projection, and said second bathing panel are formed from a single sheet of material.

17. A bathing area surround assembly comprising:

a first bathing panel;

a second bathing panel configured to move between an engaged position and a disengaged position relative to said first bathing panel;

a slot flange at a lateral edge portion of said first bathing panel;

a hook flange at a lateral edge portion of said second bathing panel; and a hook-like projection of said hook flange, said hook-like projection extending though a slot established by said slot flange when said second bathing panel is in the engaged position relative to said first bathing panel.

18. The bathing area surround assembly of claim 17, wherein said hook-like projection of said hook flange directly contacts said slot flange when said second bathing panel is in the engaged position relative to said first bathing panel.

19. A bathing area surround assembly comprising:

a first bathing panel formed from a first sheet of material;

a slot flange formed from said first sheet of material, said slot flange establishing at least one slot;

a return flange portion of said slot flange, said return flange portion extending transversely from other portions of said slot flange;

a second bathing panel formed from a second sheet of material;

a hook flange formed from said second sheet of material;

a hook-like projection of said hook flange, said hook-like projection extending transversely from other portions of said hook flange;

a compressible seal secured to said slot flange, said hook flange, or both;

wherein said hook-like projection is configured to be moved into said slot and then downward relative to said slot flange when said second bathing panel is moved to an engaged position relative to said first bathing panel, wherein a tapered end portion of said hook-like projection is configured to contact said slot flange to move at least a portion of said slot flange relatively toward at least a portion of said hook flange to compress the compressible seal when said second bathing panel is moved to the engaged position.

* * * * *